United States Patent [19]

Velarde

[11] 4,304,116

[45] Dec. 8, 1981

[54] MULTI-PART DIE ASSEMBLY FOR FORMING A CLOSED CLIP

[75] Inventor: Clyde R. Velarde, Raleigh, N.C.

[73] Assignee: Rheem Manufacturing Company, New York, N.Y.

[21] Appl. No.: 101,171

[22] Filed: Dec. 7, 1979

[51] Int. Cl.[3] ..... B21D 9/00

[52] U.S. Cl. ..... 72/383; 29/776; 29/243.53; 72/399; 72/402

[58] Field of Search ..... 72/383, 380, 402, 394, 72/399, 381, 409, 410; 29/243.56, 243.5, 776, 796

[56] References Cited

U.S. PATENT DOCUMENTS

| | | | |
|---|---|---|---|
| 1,944,251 | 1/1934 | Mansbendel | 29/243.56 |
| 3,621,704 | 11/1971 | Schaeffer | 72/383 |
| 3,688,553 | 9/1972 | Demler | 81/309 |
| 3,810,495 | 5/1974 | Pack | 29/243.56 |
| 3,899,913 | 8/1975 | Schlosser | 72/383 |
| 3,940,841 | 3/1976 | Velarde | 29/243.56 |

FOREIGN PATENT DOCUMENTS

| | | | |
|---|---|---|---|
| 42-18075 | 9/1967 | Japan | 72/381 |

*Primary Examiner*—Gene P. Crosby

*Attorney, Agent, or Firm*—Allegretti, Newitt, Witcoff & McAndrews

[57] ABSTRACT

An improved multi-part die assembly for forming a closed clip comprises a mounting structure, punch means, first and second gate-die members and simultaneous driving means. The punch means reciprocates toward and away from a clip-forming station on the mounting structure, and the gate-die members pivot toward and away from the clip-forming station. A crown die is defined on the punch means for cooperation with the crown of an open clip. First and second leg dies on the first and second gate-die members cooperate with the legs of the open clip. The simultaneous driving means drives the punch means and the first and second gate-die members simultaneously whereby the closed clip is formed by cooperation with the crown die and the leg dies.

9 Claims, 9 Drawing Figures

MULTI-PART DIE ASSEMBLY FOR FORMING A CLOSED CLIP

BACKGROUND OF THE INVENTION

This invention relates to a clip-forming mechanism, and more particularly, to an improved multi-part die assembly for forming an open clip into a closed clip. The assembly is particularly suited for the formation of a closed clip about the netting, rubber vessel and plastic stem of an aerosol container.

In the art of aerosol containers, public disdain for containers utilizing various gas propellants has directed attention toward containers utilizing elastic or balloon-like liners to supply content pressure. A desirable such container is formed with a central stem inside a rubber vessel, which is maintained under pressure by an elastic net or netting. The desired spray fluid is pumped inside the rubber vessel. In use, the spray fluid exits the container from the rubber vessel through the stem and an attached spray valve. A problem associated with the manufacture of such a container is the attachment of the netting, rubber vessel and stem at their lower ends. A clip is a desirable means for attachment, but the high degree of uniformity and pressure needed between the clip and the container components has frustrated attempts to utilize previous clip forming mechanisms.

SUMMARY OF THE INVENTION

The present invention is, in a principal aspect, an improved multi-part die assembly for forming an open clip into a closed clip. The die assembly principally comprises a mounting structure, punch means, first and second gate-die members and simultaneous driving means for the punch means and the first and second gate-die members. The mounting structure has a clip-forming station located thereon. The punch means is mounted on the mounting structure for reciprocating movement toward and away from the clip-forming station. Together, the punch means and the mounting structure define guide means, e.g., guideways, for guiding the reciprocating movement of the punch means. The first gate-die member and the second gate-die member are pivotally mounted on the mounting structure on opposite sides of the clip-forming station for pivotal movement toward and away from the clip-forming station. The punch means defines a crown die for cooperation with the crown of the open clip, and the first and second gate-die members respectively define first and second leg dies for cooperation with the two spaced legs of the open clip. The simultaneous driving means drives the punch means and the first and second gate-die members toward the clip-forming station simultaneously, whereby an open clip positioned at the clip-forming station is formed into a closed clip by cooperation of the crown die and the first and second leg dies with the open clip.

It is thus a principal object of the present invention to provide an improved multi-part die assembly for forming an open clip having a crown and two spaced legs into a closed clip.

Another object of the present invention is to provide an improved multi-part die assembly for formation of a clip which satisfies the high degree of uniformity and pressure demanded by the formation of a clip about the internal components of a spray container utilizing an expandable liner to maintain content pressure.

Another object of the present invention is to provide an improved multi-part die assembly for formation of a clip which imparts a uniform circularity to the clip as closed.

Another object of the present invention is to provide an improved multi-part die assembly for formation of a clip which is adaptable to clips having a variety of cross-sectional configurations.

A further object of the present invention is to provide an improved multi-part die assembly for formation of a clip which requires a reduced level of identity between clips to be formed.

A still further object of the present invention is to provide an improved multi-part die assembly for formation of a clip which has a streamlined and substantially less intricate driving mechanism than previous clip-forming mechanisms.

Still further objects of the present invention are to provide an improved multi-part die assembly for clip formation that is suitable for high-speed commercial operation, has an extended life and is readily manufacturable.

These and other objects, advantages and features of the present invention are apparent from the detailed description of the preferred embodiment of the invention, which follows.

BRIEF DESCRIPTION OF THE DRAWING

In the detailed description of the preferred embodiment which follows, reference is made to the accompanying drawing consisting of nine figures. Briefly, these nine figures are as follows.

DETAILED DESCRIPTION OF THE PREFERRED EMBODIMENT

Figure 2:
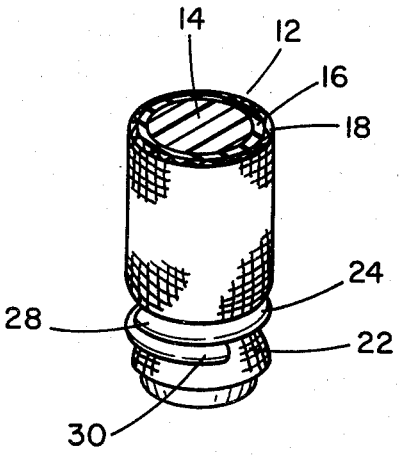
FIG. 2 is a perspective view of a truncated assembly of the internal components of a spray container having a clip illustrated as formed thereon.
Figure 3:
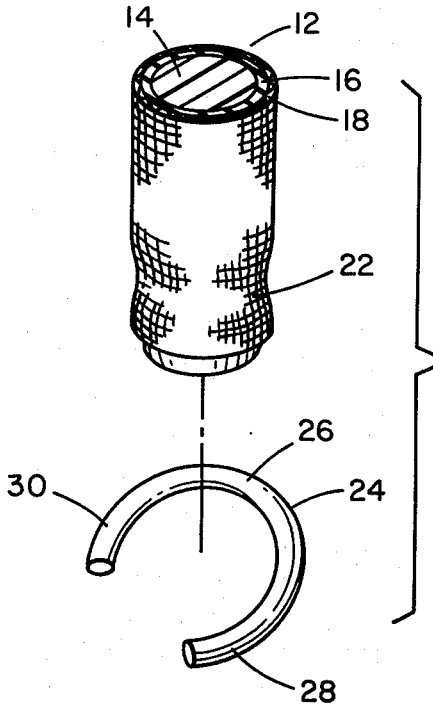
FIG. 3 is a view similar to FIG. 2 with the clip illustrated as before formation.
Figure 4:
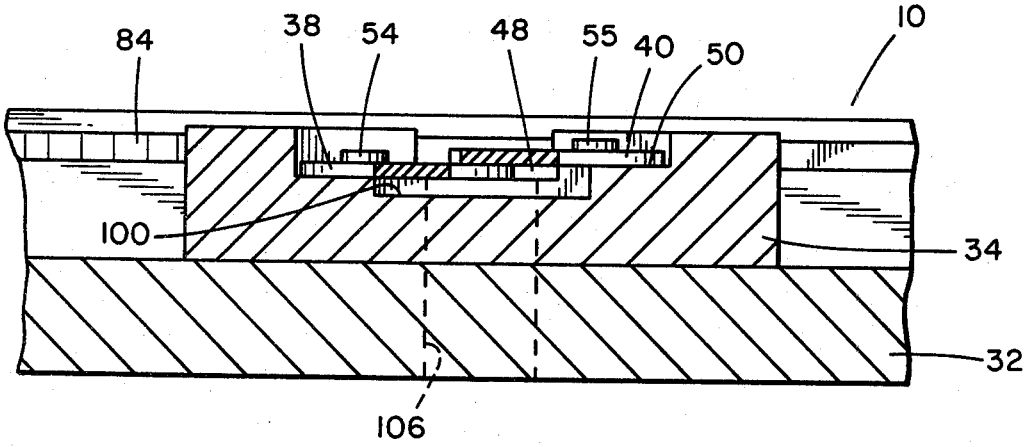
FIG. 4 is a first cross-sectional view of the preferred embodiment of the present invention taken along line 4—4 in FIG. 1.

As previously stated, the present invention is particularly suited for the formation of a closed clip about the internal components of an aerosol container which utilizes an elastic netting to maintain pressure of the spray fluid. Referring to FIGS. 2 and 3, a typical assembly 12 of such internal components includes a central stem or mandrel 14, a rubber or rubber-like vessel or liner 16, and an outer elastic net or netting 18. As typical, the vessel 16 is formed with a unitary, closed distal end or bottom 20, and the netting 18 has an open distal portion or end portion 22. Utilization of the present invention provides for the formation of a clip 24 from an open state as shown in FIG. 2 to a closed state as shown in FIG. 3 about the end portion 22 adjacent the bottom 20. Once the clip 24 is so formed, spray fluid is pumped inside the vessel 16 which expands away from the stem 14. Expansion of the vessel 16 expands or stretches the elastic netting 18. The pressure of the clip 24 on the assembly 12, because it is uniform about the circumference of the assembly 12 and sufficient in strength, maintains the position of the end portion 22 of the netting 18. Expansion thus stores energy in the netting 18, which exerts a pressure on the spray fluid and drives it from the vessel 16 when a normally closed valve (not shown) associated with the stem 14 is opened.

As best shown in FIG. 3, the clip 24 includes a crown or crown portion 26 and two spaced legs or leg portions 28, 30. The clip 24 is formed of any desired material, such as cold-forming steel or aluminum. In cross section, the clip 24 may be circular as shown, or square, hexagonal or similarly formed. When open, the clip 24 has a horseshoe-like shape with the first leg 28 spaced from the second leg 30. When closed as in FIG. 1, the clip 24 has a substantially circular shape with the first leg 28 overlapping the second leg 30. For other applications, the clip 24 may have similar shapes when open and closed.

Figure 1:
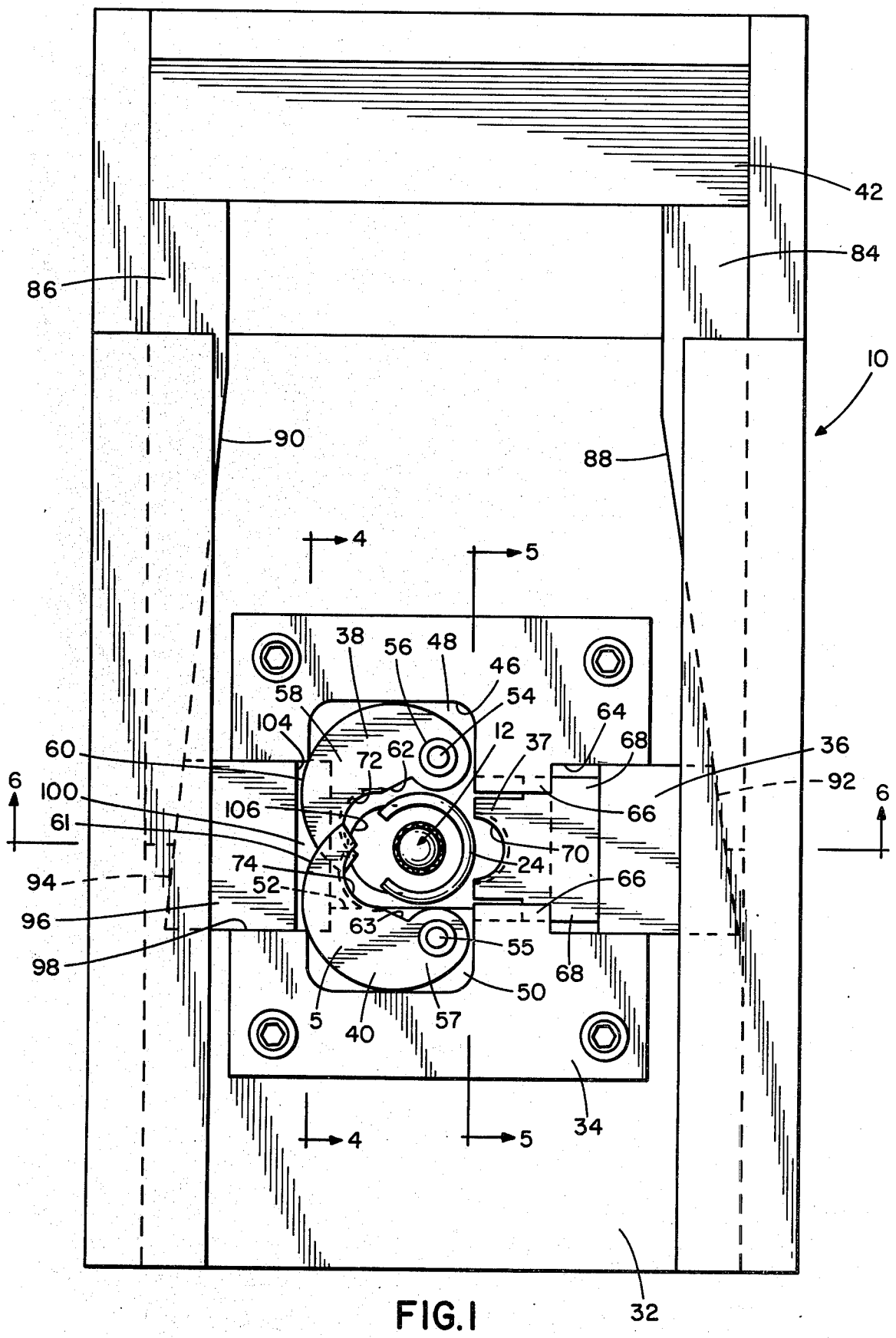
FIG. 1 is a plan view of the preferred embodiment of the present invention, illustrating the position of the components of the preferred embodiment before formation of a closed clip.

As shown in FIG. 1, the preferred embodiment of the present invention is a multi-part die assembly 10 for forming the clip 24.

The multi-part die assembly 10 includes a base support 32, a platform 34, a punch 36, a first gate-die member 38, a second gate-die member 40, and a driving mechanism 42. The punch 36 and gate-die members, 38, 40, are mounted on the platform 34, and the driving mechanism 42 and the platform 34 are mounted on the base support 32. The platform 34 and base support 32 thus define a mounting structure.

A recess 46 is defined in the upper surface of the platform 34. The recess 46 is substantially rectangular. As will be described in detail, the recess 46 defines a station on the platform 34 for the formation of a closed clip.

Figure 7:
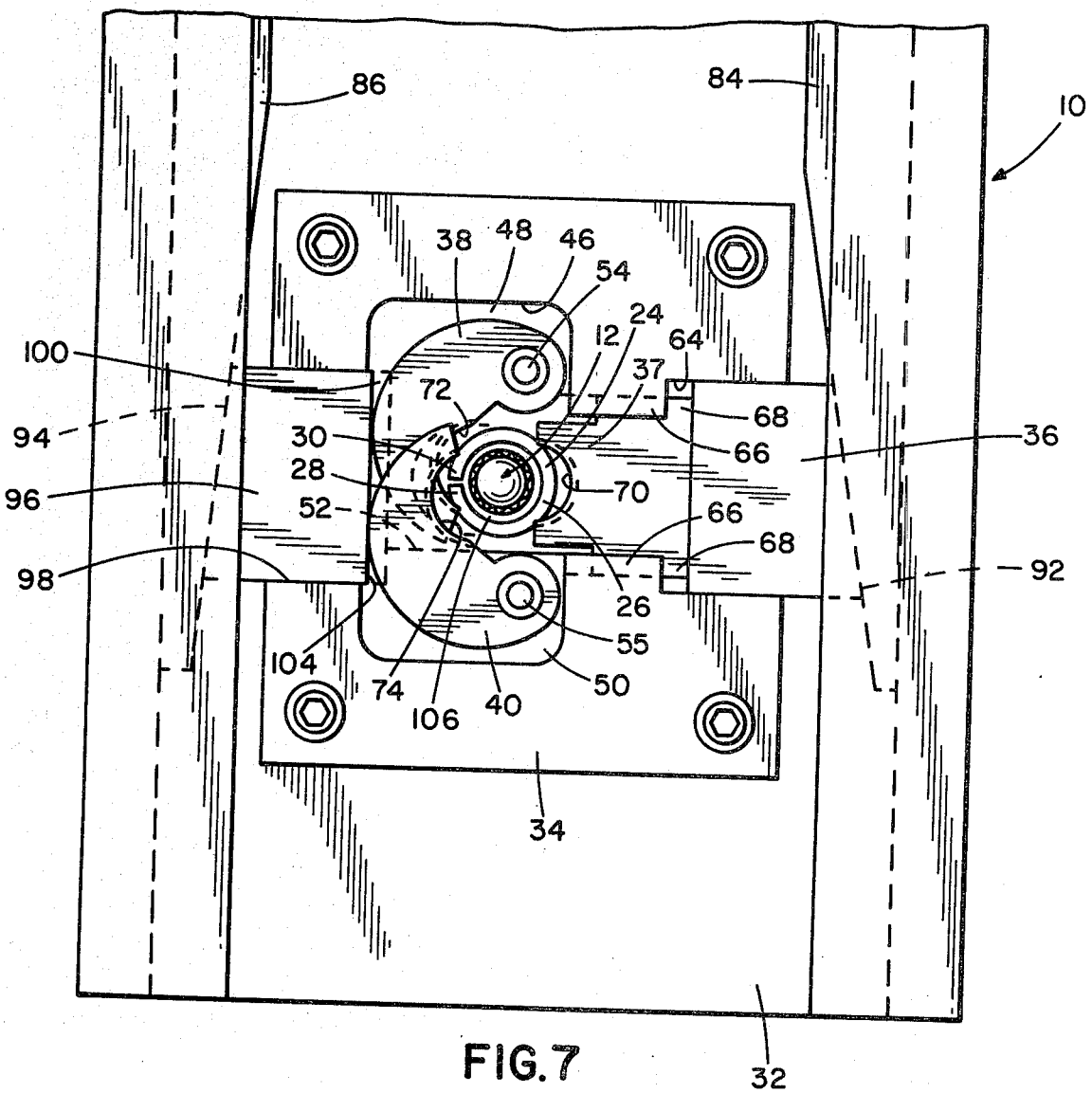
FIG. 7 is a plan view similar to FIG. 1, illustrating movement of the components of the preferred embodiment during formation of a closed clip.
Figure 8:
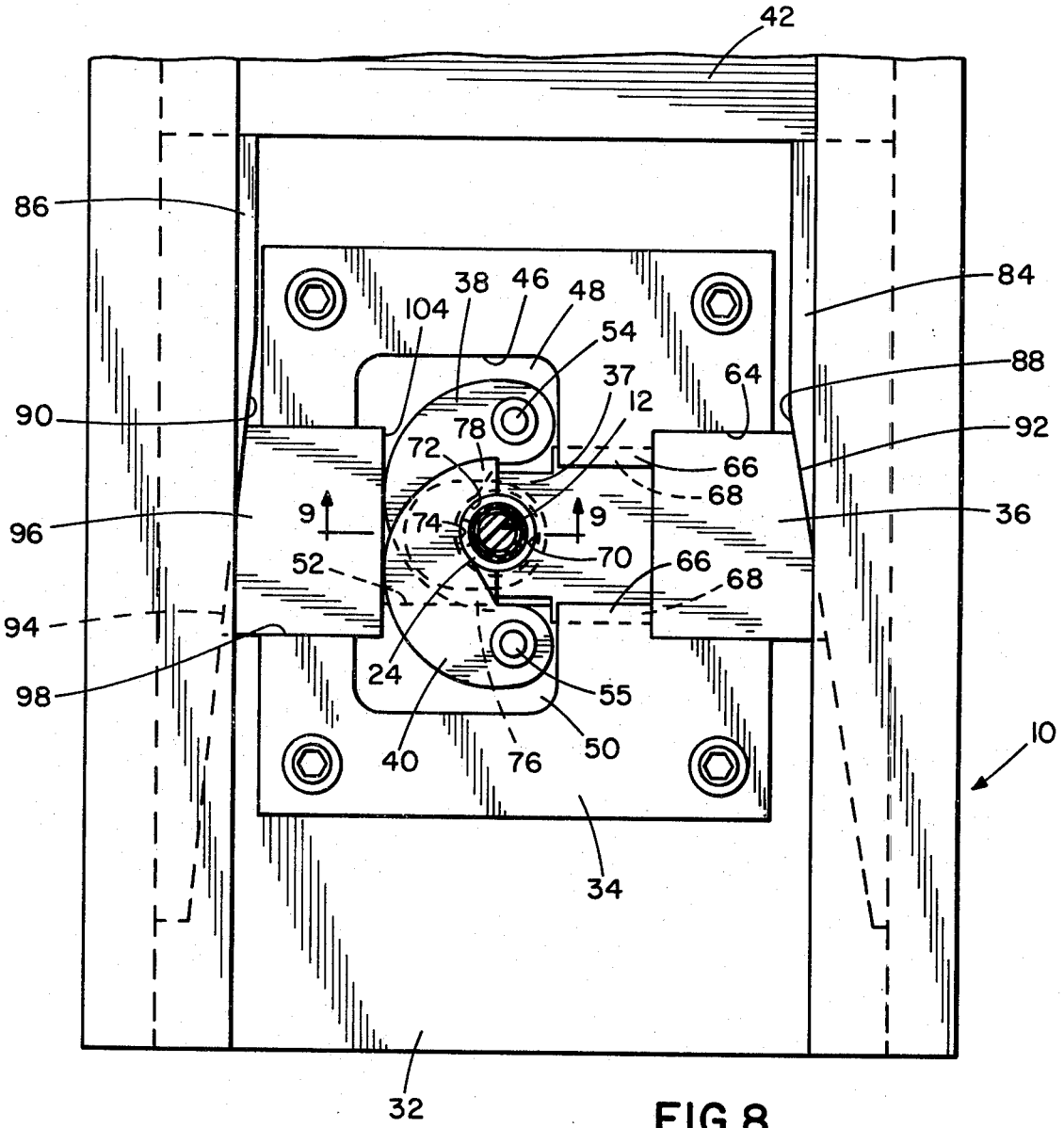
FIG. 8 is a view similar to FIGS. 1 and 7, illustrating the position of the components of the preferred embodiment upon formation of a closed clip.

At its bottom, the recess 46 has a lower surface in two portions 48, 50 of different elevations. As seen in FIGS. 1, 7 and 8, the lower portion 48 extends below the first gate-die member 38 to a ledge 52. The upper portion 50 extends from the ledge 52 below the second gate-die member 40. The heigth of the ledge 52 is substantially equal to the thickness of one of the gate-die members 38, 40.

The gate-die members 38, 40 are mounted on the platform 34 within the recess 46. The first gate-die member 38 is mounted on the lower portion 48 of the recess 46, and the second gate-die member 40 is mounted on the upper portion 50 of the recess 46. Each gate-die member 38, 40 is mounted by a pivot pin 54. The gate-die members 38, 40 pivot about their respective pivot pins 54, which are affixed to the platform 34 at equal distances from the center of the recess 46. When pivoted toward the center of the recess 46, the gate-die members 38, 40 overlap, with the second gate-die member 40 over the first gate-die member 38.

The gate-die members 38, 40 each include a pivot portion 56 and a die portion 58, as referenced in FIG. 1. The pivot portion 56 is substantially circular and has a diameter somewhat larger than the diameter of the pivot pin 54. A concentric pin opening (not shown) is drilled through the pivot portion 56 for insertion of the pivot pin 54. The die portion 58 is generally semi-circular, with its curved surface 60 away from the center of the recess 46. The pivot portion 56 and the die portion 58 are joined along the end of the inner surface 62 more remote from the center of the recess 46.

Figure 6:
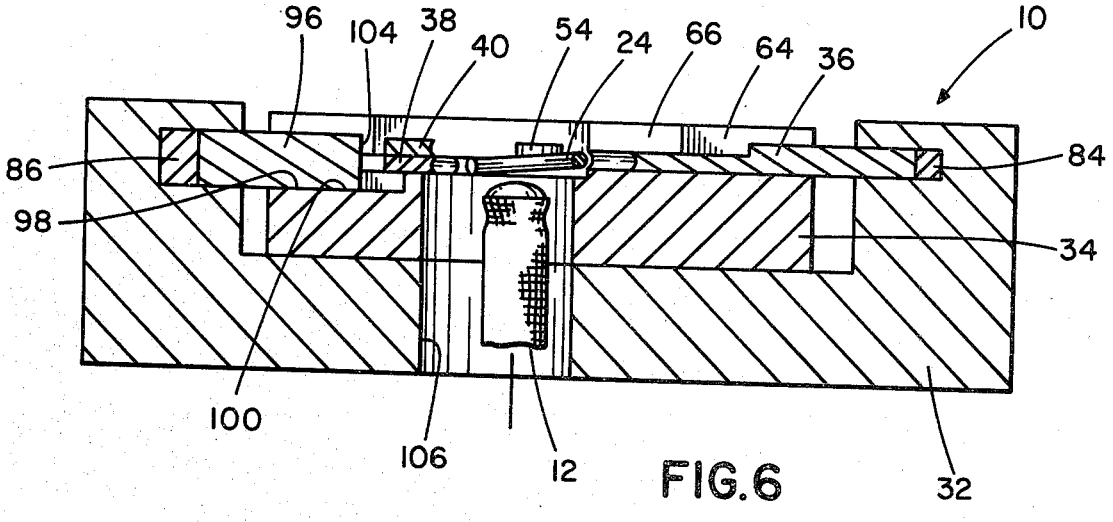
FIG. 6 is a third cross-sectional view of the preferred embodiment of the present invention taken along line 6—6 of FIG. 1.
Figure 9:
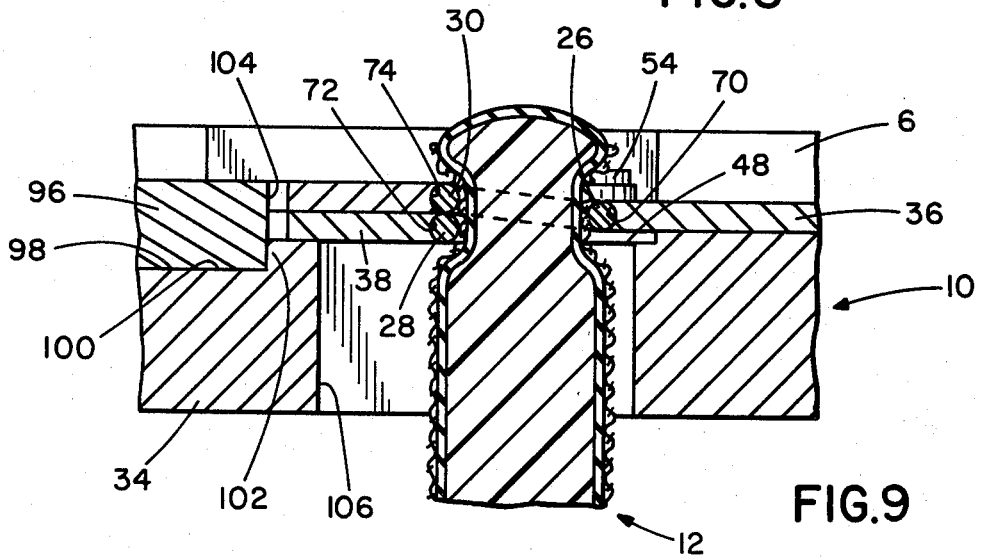
FIG. 9 is a cross-sectional view similar to FIG. 6, taken along line 9—9 of FIG. 8.

A punch channel 64 is cut along one side of the platform 34 into the recess 46. As shown in FIGS. 1 and 6–9, the punch 36 is slidably mounted in the punch channel 64. The punch 36 may slide from a position remote from the recess 46, as shown in FIGS. 1 and 6, through intermediate positions such as shown in FIG. 7 to a position adjacent the recess 46, as shown in FIGS. 8 and 9.

Flanges 66 are integrally formed on the platform 34 along at least a portion of the punch channel 64. Cooperating flanges 68 are formed along the punch 36. The platform flanges 66 extend inward of the punch channel 64 and the punch flanges 68 extend along the sides of the punch 36. The platform flanges 66 overlie the punch flanges 68. The flanges 66, 68 thus cooperatively define means for guiding movement of the punch 36.

Figure 5:
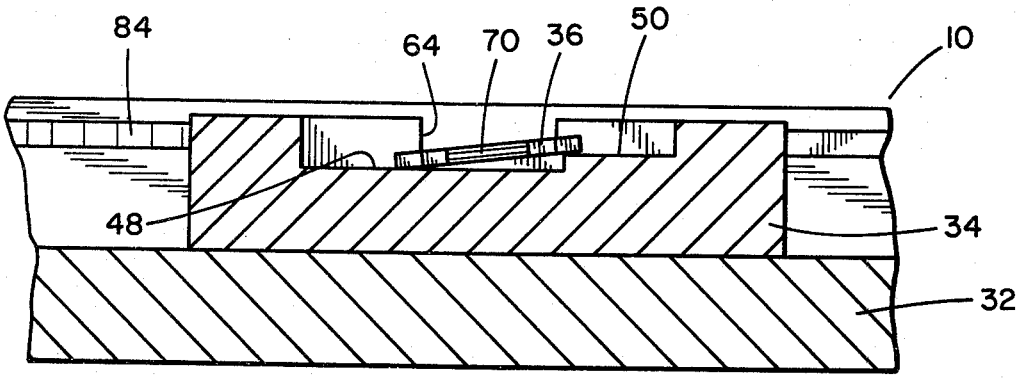
FIG. 5 is a second cross-sectional view of the preferred embodiment of the present invention as taken along line 5—5 in FIG. 1.

As shown in FIG. 5, the punch flanges 66 are tapered along their lower surfaces. As a result, the punch is tilted or skewed in relation to the bottom portions 48, 50 of the recess 46, and thus in relation to the planes of the gate-die members 38, 40. Along its side toward the first gate-die member 38, the punch 36 has an elevation substantially equal to that of the lower portion 48. Along its side toward the second gate-die member 40, the punch 36 has an elevation substantially equal to the upper portion 50.

Die grooves are formed on the punch 36 and the gate-die members 38, 40 toward the center of the recess 46. A crown die groove 70 is formed on the punch 36, a first leg die groove 72 is formed on the first gate-die member 38, and a second leg die groove 74 is formed on the second gate-die member 40. Each groove 70, 72, 74 is substantially semi-circular as seen in FIGS. 1, 7 and 8, and each is concave in cross section as seen in FIGS. 6 and 9.

When the punch 36 and the gate-die members 38, 40 are moved toward the center of the recess 46, as shown in FIG. 8, the respective outer ends 76, 78 of the gate-die members 38, 40 contact inner surface portions 80, 82, respectively, of the punch 36. In this position, the grooves 70, 72, 74 form a continuous, generally spiral groove. That is, the ends of the crown die groove 70 match in elevation the adjacent ends of the leg die grooves 72, 74. A continous groove thus begins with a first portion in a plane defined by the first leg die groove 72, moves through a second portion in a second, skewed plane defined by the crown die groove 70 and ends with a third portion in a third plane parallel to the first plane and defined by the second leg die groove 74.

As described, the grooves 70, 72, 74 form the shape of a closed clip. Thus, by inserting a clip 24 in the center of the recess 46 and simultaneously driving together the punch 36 and gate die members 38, 40, an open clip is formed into a closed clip. More particularly, when an open clip is placed in the center of the recess 46 with its crown 26 toward the punch 36 and its first leg 28 toward the first gate die member 38, and when the punch 36 and gate die members 38, 40 are driven together, the die grooves 70, 72, 74 guide the clip 24 through formation into a closed clip. A clip appropriately placed is shown in FIG. 1. As shown in FIG. 7, movement of the punch 36 toward the clip 24 places the crown 26 of the clip 24 in contact with the crown die groove 70. Movement of the first gate die member 38 toward the clip 24 places the first leg 28 of the clip 24 in contact with the first leg die groove 72. Movement of the second gate-die member 40 toward the clip 24 places the second leg 30 of the clip 24 in contact with the second leg die groove 74. With the application of sufficient driving force, the clip 24 is closed. The crown die groove 70 guides and shapes the crown 26, the first leg die groove 72 guides and shapes the first leg 28 and the second leg die groove 74 guides and shapes the second leg 30. When the gate-die members 38, 40 contact the punch 36, as shown in FIG. 8, the clip 24 assumes the shape of the continuous die groove formed by the die grooves 70, 72, 74 and is thus closed, with its legs 28, 30 overlapping. Because of the shapes and spacial relations of the die grooves 70, 72, 74, the clip 24 closed has the shape of a circular spiral extending greater than 360° and less than 540°.

To provide simultaneous movement of the punch 36 and the gate-die members 38, 40, the driving mechanism 42 includes a pair of opposed cam members 84, 86. Each cam member 84, 86 has a sloping cam surface, respectively 88 and 90. A cam surface 92 is formed on the punch 36 for cooperation with the cam surface 88. A cam surface 94 is formed on a driving member 96 for cooperation with the cam surface 90. The driving member 96 is slidably mounted in a driver channel 98 formed in the platform 34. The driver channel 98 opens into the recess 46 and has a lower surface 102 below the lower portion 48. A shoulder 100 is thus defined, which limits inward movement of the driver 96. The driver 96 has an inner face 104 perpendicular to its axis of movement. The inner face 104 cooperates with the curved surfaces 60 of the gate-die members 38, 40 so that movement of the driver 96 toward the center of the recess 46 pivots the gate-die members 38, 40 toward that center. Selection of a suitable relationship of lengths of the driver 96 and the punch 36 provides simultaneous movement of the punch 36 and the gate-die members 38, 40.

As described, the assembly 10 provides the formation of an open clip having a crown and two spaced legs into a closed clip. Downward movement of the driving mechanism 42, as seen by comparing FIGS. 1, 7 and 8, moves the punch 36 and the gate-die members 38, 40 simultaneously toward an open clip, which is guided and formed by the die grooves 70, 72, 74.

As initially stated, the preferred embodiment is a multi-part die assembly 10 for forming a closed clip about an assembly 12. So that the die assembly 10 may be so utilized, a channel 106 is cut through the base support 32 and platform 34 below the center of the recess 46. As shown in FIG. 6, an assembly 12 is inserted through the channel 106 and extended through the central opening of an open clip. Maintaining the assembly 12 in this position through the process of closing the clip results in the clip being formed about the assembly 12, as shown in FIGS. 2 and 6–9. When removed, the assembly 12 includes a closed clip as shown in FIG. 2.

As should now be apparent to those of ordinary skill in the art, a highly useful and advantageous multi part die assembly for forming an open clip having a crown and two spaced legs into a closed clip has been described in detail. This description enables any person skilled in the art to make and use this assembly. If the clips to be formed are steel, a suitable material for the punch and gate-die members is high strength die tool steel, with the remaining components formed of the same or another suitable steel.

To particularly point out and distinctly claim the subject matter which is regarded as the invention, the following claims conclude this specification.

What is claimed is:

1. An improved multi-part die assembly for forming an open clip having a crown and two spaced legs into a closed clip comprising:

a mounting structure having a clip-forming station located thereon;

punch means mounted on said mounting structure for reciprocating movement toward and away from said clip-forming station, said punch means and said mounting structure cooperatively defining means for guiding said reciprocating movement, said punch means defining a crown die for cooperation with said crown;

a first gate-die member and a second gate-die member pivotally mounted on said mounting structure on opposite sides of said clip-forming station for pivotal movement toward and away from said clip-forming station, said first gate-die member defining a first leg die for cooperation with one of said two spaced legs and said second gate-die member defining a second leg die for cooperation with the other of said two spaced legs; and means for simultaneously driving the first and second gate-die members and the punch means toward said clip-forming station, said first leg die overlapping said second leg die when said gate-die members are both pivoted toward the clip forming station;

whereby an open clip positioned at said clip-forming station is formed by cooperation of said crown die and said first and second leg dies with said open clip into a closed clip having overlapping legs.

2. A die assembly as in claim 1 wherein said crown die and said first and second leg dies together have substantially the shape of said closed clip.

3. A die assembly in claim 1 in which said simultaneous driving means includes means for driving said first and second gate-die members toward said clip-forming station and in which said first and second gate-die members each has a curved driving surface away from said clip-forming station for engagement by said driving means.

4. A die as in claim 1 in which the pivotal axes about which said first and second gate-die members pivot are opposite each other across the axis defined by the reciprocating movement of said punch means.

5. A die assembly as in claim 1 in which said mounting structure at said clip-forming station defines a channel through which a workpiece may be inserted into said clip-forming station so that said closed clip is formed about said workpiece.

6. A die assembly as in claim 1 for forming a substantially circular closed clip in which said crown die, said first leg die and said second leg die each has substantially the shape of a sector of a circle.

7. A die assembly as in claim 1 in which said crown die, said first leg die and said second leg die are each substantially semi-circular.

8. A die assembly as in claim 1 in which said crown die, said first leg die and said second leg die include a die groove facing said clip-forming station.

9. A die assembly as in claim 8 in which said die groove of said crown die defines a first skewed reference plane; said die groove of said first leg die defines a second reference plane, a portion of said second die groove intersecting said first reference plane; and said die groove of said second leg die defines a third reference plane, a portion of said first die groove intersecting said first reference plane.

* * * * *